United States Patent [19]

Eckstein et al.

[11] Patent Number: 4,805,608

[45] Date of Patent: Feb. 21, 1989

[54] BREATHING APPARATUS

[75] Inventors: Wolfgang Eckstein, Sereetz; Günther Kolbe, Mölln, both of Fed. Rep. of Germany

[73] Assignee: Drägerwerk Aktiengesellschaft, Lübeck, Fed. Rep. of Germany

[21] Appl. No.: 31,942

[22] Filed: Mar. 27, 1987

[30] Foreign Application Priority Data

Mar. 27, 1986 [DE] Fed. Rep. of Germany ..... 3610492

[51] Int. Cl.[4] ..... A62B 7/08

[52] U.S. Cl. ..... 128/202.26; 128/205.17; 128/205.73

[58] Field of Search ..... 128/202.22, 202.26, 128/205.12, 205.17, 205.23; 73/29, 52; 116/206, 205, 200; 55/270, DIG. 34, DIG. 33, 271; 44/3 B; 422/119, 120, 126, 123, 122

[56] References Cited

U.S. PATENT DOCUMENTS

| | | | |
|---|---|---|---|
| 2,444,029 | 6/1948 | Bowen | 128/202.26 |
| 3,277,890 | 10/1966 | Warncke | 128/205.17 |
| 3,615,250 | 10/1971 | Vernon | 128/202.26 |
| 3,773,044 | 11/1973 | Wallace | 28/202.22 |
| 3,942,524 | 3/1976 | Li et al. | 128/202.26 |
| 4,019,509 | 4/1977 | Li et al. | 128/202.26 |
| 4,292,967 | 10/1981 | Pasternack | 73/29 |
| 4,440,162 | 4/1984 | Sewell et al. | 73/29 |

FOREIGN PATENT DOCUMENTS

| | | | |
|---|---|---|---|
| 1961910 | 6/1971 | Fed. Rep. of Germany . | |
| 2163125 | 6/1973 | Fed. Rep. of Germany | 128/202.26 |
| 2758603 | 7/1978 | Fed. Rep. of Germany | 128/202.22 |
| 8015449 | 10/1980 | Fed. Rep. of Germany . | |
| 345672 | 9/1930 | United Kingdom | 128/202.22 |
| 2119659 | 11/1983 | United Kingdom | 128/202.26 |

*Primary Examiner*—Edward M. Coven
*Assistant Examiner*—K. M. Reichle
*Attorney, Agent, or Firm*—Walter Ottesen

[57] ABSTRACT

A breathing apparatus removably mounted in a housing has a device for processing the breathing gas. This device includes a container and a charge for processing the breathing air which is disposed in the container. The container has air pass-through openings at least one of which is closable with a stopper. The breathing apparatus provides an indication of possible entry of water vapor and this indication is limited to only the water-vapor sensitive parts of the breathing apparatus. For this purpose, a charge is provided in the stopper having a moisture-sensitive indicator which is visible through a viewing window from outside the housing and this charge is in gas contact with the charge of the device for processing the breathing gas.

5 Claims, 2 Drawing Sheets

BREATHING APPARATUS

FIELD OF THE INVENTION

The invention relates to a breathing apparatus in a housing and having a device for processing the breathing gas. This device includes a container having air pass-through openings at least one of which is closable with a stopper. A charge for processing the breathing gas is disposed in the container.

BACKGROUND OF THE INVENTION

A breathing apparatus of this type is disclosed in German Utility Model DE-GM 80 15 449.

This publication describes a breathing apparatus in the form of an emergency filter apparatus with a protective hood. The filter apparatus contains a combined submicron particulate and carbon monoxide (CO) filter with an air inlet opening and an air outlet opening.

The air outlet opening is surrounded by a half-mask to which a protective hood is attached. In the position ready for use, the air inlet and air outlet openings are each closed with a stopper to protect the filter material from damage, or to prevent impairment by humidity of the catalyst in the CO filter which is required for filtering carbon monoxide. For use, the emergency filter apparatus is removed from the housing, and during this removal, both stoppers are loosened from the respective air pass-through openings.

Other breathing apparatus include a cartridge for processing the breathing gas and this cartridge is filled with a chemical that binds carbond dioxide ($CO_2$) and gives off oxygen. In these apparatus the entire housing is sealed in an air-tight manner. At a suitable location on the housing, one that is visible to the wearer, a container having moisture-sensitive material is attached, by means of which the tightness of the supporting housing can be monitored. In this connection, reference can be made to published German patent application DE-OS 19 61 910.

The prerequisite for a reliable and accurate indication by the moisture-sensitive indicator is that the housing in which the breathing apparatus is located is sealed in an air-tight manner. For this purpose expensive sealing and fastening elements are required.

SUMMARY OF THE INVENTION

In view of the foregoing, it is the object of the invention to provide a breathing apparatus wherein the indication of the content of water vapor can be restricted to only those parts of the breathing apparatus which are sensitive to water vapor.

The breathing apparatus according to an embodiment of the invention is removably mounted in a housing. The breathing apparatus includes a device for processing the breathing air which includes a container having air pass-through openings and charge means disposed in the container for processing the breathing air. A stopper for closing at least one of the openings is provided and moisture-sensitive means are held in the stopper so as to be in gas contact with the charge means. Window means are provided for viewing the moisture-sensitive means from outside of the housing.

Thus, and according to a feature of the invention, a charge having a moisture-sensitive indicator is placed in the stopper and this indicator is visible from outside the housing through a viewing window and is in gas contact with the charge of the processing device.

The primary advantage of the breathing apparatus of the invention is that the outer housing no longer has to be hermetically sealed. The water-vapor sensitive indicator now indicates only the moisture content in the processing device. The placement of the charge in the stopper can be used both in emergency filter apparatus where the moisture load of a carbon-monoxide filter can, for example, be indicated, as well as in a breathing apparatus wherein the exhaled air is processed and inhaled again by the user. In the latter the charge in the stopper indicates the moisture loading of the cartridge that binds carbon dioxide and releases oxygen.

In a breathing apparatus having a chemical cartridge, the stopper is advantageously placed in the air pass-through opening to which a breathing bag is attached.

According to another feature of the invention, the stopper is configured as a sack that contains the moisture-sensitive charge between a felt-like foil and a transparent foil. The contents of the sack are visible through the transparent foil facing the viewing window.

For further stabilizing and mechanically reinforcing the bag wall, the breathing bag is mounted such that a partition piece having a plurality of openings formed therein extends over the felt-like foil. In this way, the breathing bag can be made as one piece in the region of the air-inlet opening, and only small openings for the entry of gas to the moisture-sensitive indicator have to be provided.

BRIEF DESCRIPTION OF THE DRAWINGS

The invention will now be described in further detail with reference to the drawing, wherein.

DESCRIPTION OF THE PREFERRED EMBODIMENTS OF THE INVENTION

Figure 1:
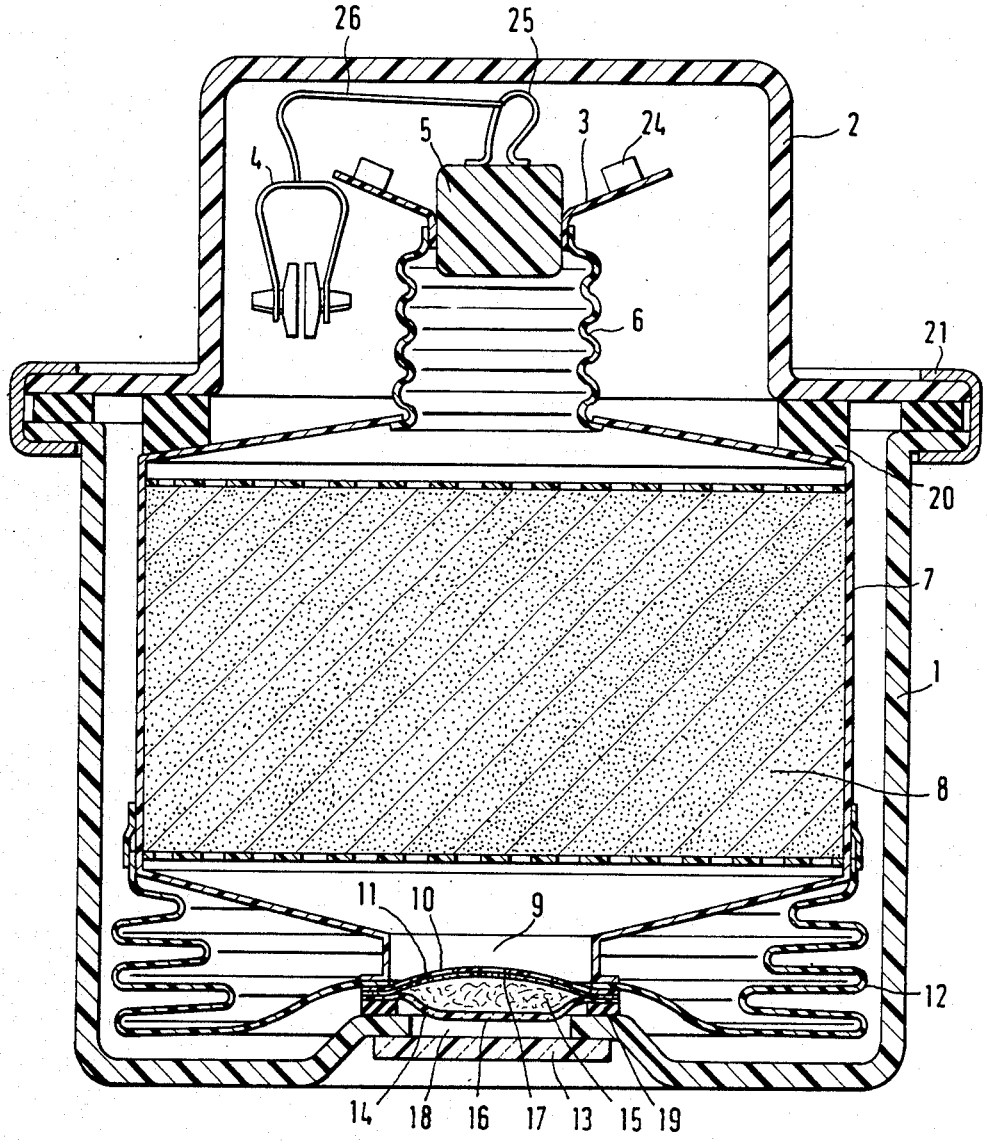
FIG. 1 is a cross section taken through an embodiment of the breathing apparatus of the invention in the state in which it is shipped; and, FIG. 2 is a fragmentary view, partially in section, taken through the breathing bag during operation.

The breathing apparatus shown in FIG. 1 is located in a housing 1 which is closed by a cover 2. The mouthpiece 3 and a required nose clip 4 are accommodated in the cover 2. Reference numeral 24 indicates appendages of the mouthpiece 3 which the user clamps between the teeth to hold the mouthpiece in position. The opening of the mouthpiece 3 is closed with a stopper 5 equipped with a loop 25 to facilitate removal thereof. A thread 26 holds the nose clip 4 during shipment. The mouthpiece 3 extends via a corrugated hose 6 to a container 7 in which a chemical 8 that binds carbon dioxide ($CO_2$) and releases oxygen ($O_2$) is located. The chemical 8 can be, for example, an alkali-based chemical.

An air pass-through opening 9 is provided on the end of the container 7 opposite the mouthpiece 3. A piece 11 of the breathing bag 12 is provided with openings 10 and is placed in front of this air pass-through opening 9. A viewing window 13 is provided in the side of the housing 1 adjoining the air pass-through opening 9. A sack 14 is visible through the window 13 and is located in front of the piece 11. The sack 14 contains a filling or charge 15 having a moisture-sensitive indicator. The indicator is a colorless substance which takes on a color in the presence of moisture and can be, for example, a silicone gel.

The filling 15 is surrounded toward the viewing window 13 by a transparent foil strip 16 and toward the openings 10 by an air-permeable felt-like strip of fabric 17 which are fused to one another to define a common peripheral edge. The strips 16, 17 are cut from respective pieces of material to the form of the window 13. The fused edge is attached in a gas-tight manner to the breathing bag 12 by means of a fastening 23. The connection between the air pass-through opening 9, the piece 11 of the breathing bag 12 and the strips 16, 17 of the sack 14 is supported by an elastic seal 19 that surrounds the opening 18 of the housing 1.

The cover 2 is fastened to the housing 1 in such a way that a pressure piece 20, which extends around the container 7, rests between the cover 2 and the container 7. The pressure piece 20 presses the bag edge tightly against the gas pass-through opening 9 by means of the clamp means 21. This holds the breathing apparatus in a shock-resistant manner inside the housing 1.

Figure 2:
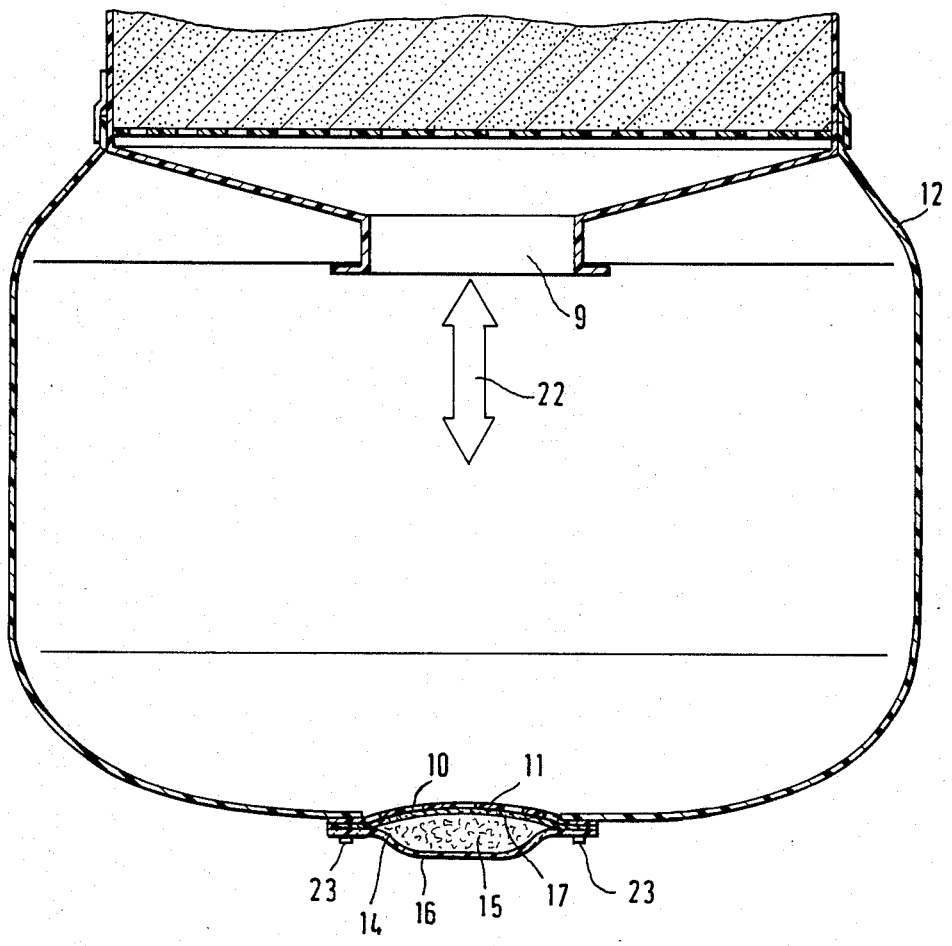

IN FIG. 2, the breathing apparatus has been taken out of the housing 1 for use and the breathing bag 12 is unfolded. With the stopper 5 removed, the breathing apparatus can now be used for breathing via the mouthpiece 3. The flow direction of the breathing gas is indicated by the arrow 22. The sack 14 is now removed from the air pass-through opening 9 and is located on the lower portion of the breathing bag 12.

It is understood that the foregoing description is that of the preferred embodiments of the invention and that various changes and modifications may be made thereto without departing from the spirit and scope of the invention as defined in the appended claims.

What is claimed is:

1. In a breathing apparatus for a person including means for processing breathing air and housing means for enclosing said processing means until required for use, wherein the improvement comprises:

said means for processing the breathing air including: a container having first and second breathing air pass-through openings; breathing conduit means connected to said first opening for use by the person when breathing with the apparatus; chemical means disposed in said container for processing the breathing air;

stopper means for closing said second opening until said container is required for use; and, moisture-sensitive means held in said stopper means in gas contact with said chemical means for visually indicating the presence of moisture in said container; and, window means for permitting viewing of said moisture-sensitive means from outside of said housing means.

2. The breathing apparatus of claim 1, said chemical means being a chemical means for binding carbon dioxide and releasing oxygen; the breathing air processing means further comprising: a breathing bag having a closed end and an open end, said open end attached to said container in surrounding relationship to said second opening and having a collapsed condition when said processing means is not in use and disposed in said housing means and an extended condition when said processing means has been removed from said housing means; and, said stopper means mounted on said breathing bag for closing said second opening when said breathing bag is in said collapsed condition.

3. The breathing apparatus of claim 2, said breathing bag havig at least one aperture formed therein opposite said second opening and said stopper means being a small sack overlying said at least one aperture on the exterior surface of said bag and holding said moisture-sensitive means; said sack including: a felt-like wall adjacent said at least one aperture and a transparent foil overlying said felt-like wall; and, the peripheries of said felt-like wall and said foil attached to each other and to said breathing bag about said at least one aperture so as to cause said felt-like wall and said foil to conjointly define an enclosed space for accommodating said moisture-sensitive means therein.

4. The breathing apparatus of claim 3, wherein said at least one aperture comprises a plurality of aperturs formed in said breathing bag to permit said gas contact between said chemical means and said moisture-sensitive means.

5. A breathing arrangement comprising:

a device for processing breathing air;

said device including: a container having first and second breathing air pass-through openings; breathing conduit means connected to said first opening and adapted for use by a person when breathing with the apparatus;

chemical means disposed in said container for processing the breathing air; stopper means for closing said second opening until said container is required for use; and, moisture-sensitive means held in said stopper means in gas contact with said chemical means for visually indicating the presence of moisture in said container;

removable housing means for enclosing said device until required for use; and, window means mounted in said housing means for permitting viewing of said moisture-sensitive means from outside of said housing means.

* * * * *